United States Patent [19]

Elsener

[11] 4,132,099

[45] Jan. 2, 1979

[54] FOUR-ROLLER WORKPIECE BENDING MACHINE

[75] Inventor: Fritz Elsener, Nenzlingen, Switzerland

[73] Assignee: Chr. Hausler AG, Switzerland

[21] Appl. No.: 851,848

[22] Filed: Nov. 16, 1977

Related U.S. Application Data

[63] Continuation-in-part of Ser. No. 754,038, Dec. 23, 1976, abandoned.

[30] Foreign Application Priority Data

Jan. 29, 1976 [CH] Switzerland ..... 1102/70

[51] Int. Cl.[2] ..... B21D 5/08

[52] U.S. Cl. ..... 72/175; 72/249

[58] Field of Search ..... 72/169–175, 72/249

[56] References Cited

U.S. PATENT DOCUMENTS

| | | | |
|---|---|---|---|
| 1,745,539 | 2/1930 | Hume | 72/169 |
| 2,640,525 | 8/1953 | Le Tourneau | 72/169 |
| 3,623,349 | 11/1971 | Hausler | 72/171 X |

*Primary Examiner*—Milton S. Mehr
*Attorney, Agent, or Firm*—McGlew and Tuttle

[57] ABSTRACT

The machine comprises a frame, a first roller rotatably supported by the frame and a second roller rotatably supported by the frame and disposed below the first roller to cooperate therewith. A gear is secured to the first roller to be rotatable therewith meshes with at least two pinions, each mounted on the shaft of a respective pressure-fluid operable motor. A pump is connected to each of the pressure-fluid operable motors to supply pressure-fluid in common to the motors so that all the pressure-fluid operable motors operate in synchronism.

4 Claims, 3 Drawing Figures

FOUR-ROLLER WORKPIECE BENDING MACHINE

CROSS-REFERENCE TO RELATED APPLICATION

This application is a continuation-in-part of application Ser. No. 754,038, filed Dec. 23, 1976, for "Four-Roller Workpiece Bending Machines", now abandoned.

FIELD AND BACKGROUND OF THE INVENTION

This invention relates to a four-roller workpiece bending machine, provided with a driven upper roller and a driven lower roller, and, more particularly, to a novel and improved four-roller workpiece bending machine having such a driven upper roller and a driven lower roller.

In some known machines of this type, the upper roller is inclinable and the lower roller is vertically displaceable. The two rollers are commonly driven by a locally fixed drive motor through a reduction gear and respective transmission shafts, with each transmission shaft being provided with two universal or cardan joints and a length compensating device, so that the lower roller may be displaced vertically and the upper roller may be pivoted. The drive motor may be an hydraulic motor or may be an electric motor. Also, two hydraulic or electric motors can be provided and be so connected that neither of the two rollers slides relative to the workpiece even when the workpiece has already been bent strongly and, in addition, is still relatively thick.

This kind of drive mechanism is difficult to manufacture and, moreover, requires a considerable amount of space, which is not always available in modern workshops.

There is also known an apparatus for the bending of metal sheets using two axially parallel driven lower rollers which are journalled in a horizontally displaceable carriage, and each of which, at one end, has a respective gear secured thereto and meshing with an intermediate gear journalled in the carriage. A non-driven upper roller is journalled externally of the carriage above the lower rollers. Two hydraulic motors are arranged on the carriage for driving the lower rollers, and are coaxial with the respective rollers. These hydraulic motors are connected to the associated lower rollers at respective opposite ends thereof. Thereby, it is attained that each lower roller is driven, at one end, directly by the hydraulic motor and, at its other end, through the meshing gears.

Although, with this apparatus, the power required to drive the lower rollers is reduced, the hydraulic motors must, however, and just as before, be so large that only expensive special productions can be used. Moreover, there still remains the considerable space requirement because of the large size of the hydraulic motors.

Another known sheet bending machine has an upper roller pivotable upwardly, about one end, for drawing off of the finished sheet metal cylinder, and at least two lower rollers which are angularly displaced relative to each other and which are displaceable relative to the upper roller. At least one of these rollers is driven. With a driven upper roller, a drive unit, consisting of an hydraulic motor with a reduction gear connected downstream thereof, is secured to the pivotable bearing block of this roller. The drive shaft of the reduction gear is coupled directly with the end spigot of the upper roller. With this arrangement, the drive unit is moved, together with the pivotable bearing block of the upper roller, and thus follows the pivoting out and in of the upper roller for the drawing off of the finished bent sheet metal cylinder.

Although a torque transmission shaft between the drive unit and the associated drive roller thus is no longer necessary, the reduction gear is still necessary in the same manner as before, which means an appreciable technical effort, forms a source of trouble, and increases the overall length of the sheet metal bending machine.

SUMMARY OF THE INVENTION

In accordance with the present invention, a four-roller workpiece bending machine comprises a frame, a first roller rotatably supported by the frame, a second roller rotatably supported by the frame and disposed below the first roller to cooperate therewith, a spur gear fixed on the first roller to rotate therewith, at least two pinions meshing with the spur gear and each mounted on the shaft of a respective pressure-fluid operable motor, a spur gear secured on the second roller to rotate therewith, at least one further pinion meshing with the spur gear on the second roller and secured on the shaft of a respective further pressure-fluid operable motor, and pump means commonly connected to all the motors to supply pressure-fluid thereto.

Expediently, one of the two spur gears, preferably the lower spur gear, is mounted, together with the pinions meshing with it, in a bearing block which is vertically displaceable together with the respective roller. In the pinion-gear drive mechanisms, which thus serve to drive the two rollers, spur gears of a small modulus may be used, and this is a further advantage of a four-roller workpiece bending machine embodying the invention.

An object of the invention is to provide an improved four-roller workpiece bending machine.

Another object of the invention is to provide such a machine requiring considerably less space than known bending machines of a like type.

A further object of the invention is to provide such a four-roller workpiece bending machine in which gears of a small modulus may be used to drive the rollers.

For an understanding of of the principles of the invention, reference is made to the following description of a typical embodiment thereof as illustrated in the accompanying drawing.

DESCRIPTION OF THE PREFERRED EMBODIMENT

Figure 1:
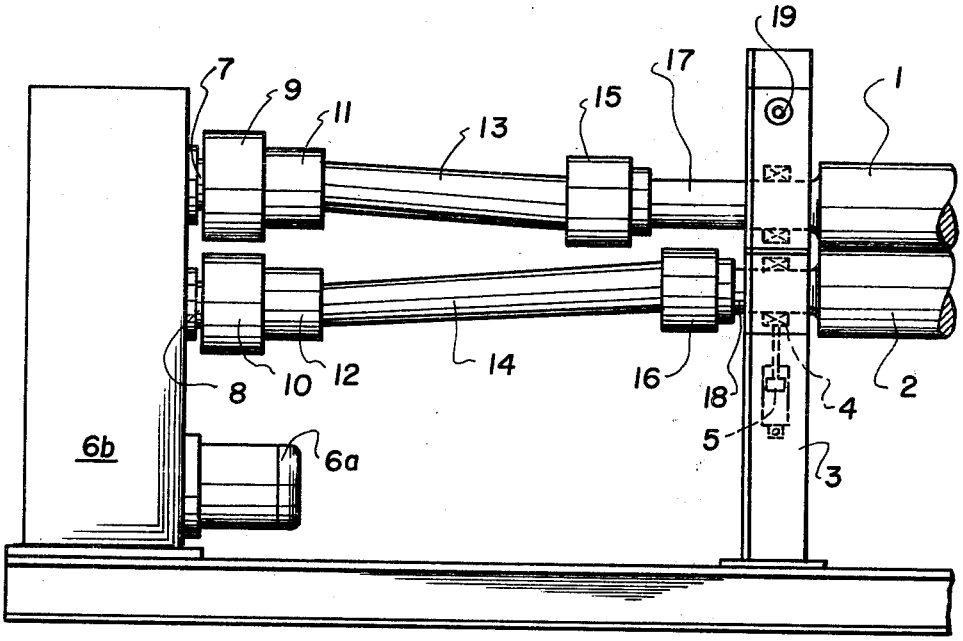
FIG. 1 (PRIOR ART)
FIG. 1 is a side elevation view of part of a known four-roller sheet bending machine.

In the three figures of the drawing, the lateral rollers and their adjusting devices have not been shown, in the intereset of clarity of representation.

FIG. 1 illustrates a known four-roller sheet bending machine in which a lower roller 2 is journalled in a vertically displaceable bearing 4 in a drive stand 3. Bearing 4 can be adjusted upwardly or downwardly by an hydraulically actuable piston 5 and held in any desired setting. The bending machine includes a motor 6*a* which drives two reduction gears accommodated in a gear box 6*b*, and which are operatively associated with respective drive shafts 7 and 8. Drive shaft 7 is connected, through a friction clutch 9 and a universal joint 11, with a transmission shaft 13 which, in turn, is connected, through a further universal or cardan joint 15, with a shaft stub 17 of upper roller 1 so as to be rotatable therewith. In a similar manner, drive shaft 8 is connected, through a friction clutch 10 and a universal or cardan joint 12, with a transmission shaft 14 which, in turn, is connected through a second universal or cardan joint 16, with a shaft stub 17 of lower roller 2 so as to be rotatable therewith. Expediently, each transmission shaft 13 and 4 comprises two parts which are displaceable axially relative to each other but which are secured against rotation relative to each other. Upper roller 1 is mounted for pivoting about a pivot axis 19, and lower roller 2 is journalled to be vertically displaceable. Consequently, the spacing between the pairs of universal joints 11, 15 and 10, 16 serving for driving the respective rollers 1 and 2 may change during operation of the machine.

Gear box 16*d* and drive stand 3, with the parts disposed therebetween, require considerable space, for example, several meters. FIG. 1 does not illustrate a pressure oil pump, which is required to generate oil pressure when the motors are hydraulic motors. Alternatively, when the motors are direct current motors, an electrical generator (not shown) is required.

Figure 2:
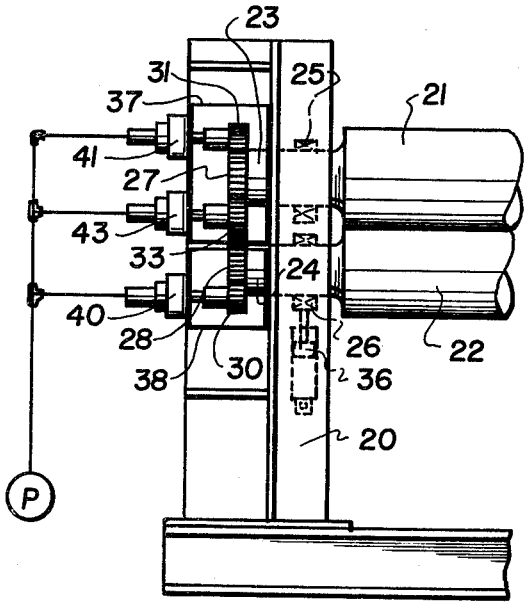
FIG. 2 is a partial side elevation view of the same part of a four-roller sheet bending machine embodying the invention.
Figure 3:
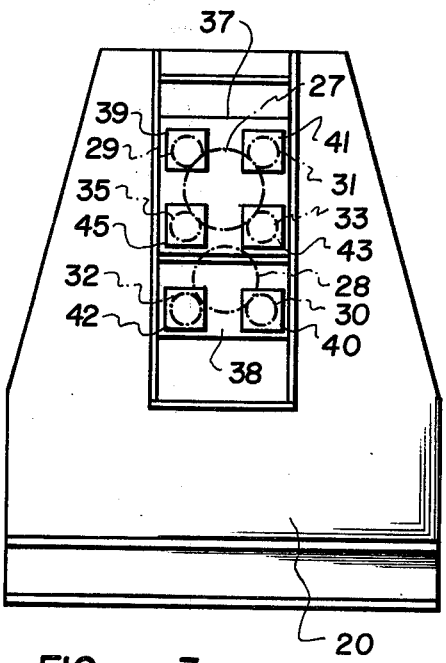
FIG. 3 is an end elevation view of the part of the machine shown in FIG. 2.

FIGS. 2 and 3 illustrate part of the drive mechanism of a four roller bending machine embodying the invention and including an upper roller 21 and a lower roller 22. Rollers 21 and 22 have respective shaft stubs 23 and 24 journalled, to be freely rotatable, in respective bearings 25 and 26 mounted in a frame 20. Bearing 26 of lower roller 22 is vertically displaceable in a known manner by means of the piston 36 of a linear hydraulic actuator, and the bearing is fixable in any position. Respective spurs gears 27 and 28 are secured non-rotatably on the free ends of shaft stubs 23 and 24. Four pinions 29, 31, 33 and 35 mesh with spur gear 27, and two pinions 30 and 32 mesh with spur gear 28. Each of these six pinions is secured on and rotatable with the output shaft of a respective hydraulic motor 39, 40, 41, 42, 43 and 45.

Pinions 29, 31, 33 and 35, shaft stub 23 and spur gear 27 are journalled in a bearing block 37 which also mounts the respective hydraulic motors 39, 41, 43 and 45. Similarly, hydraulic motors 40 and 42, with their associated pinions 30 and 32, shaft stub 24 and spur gear 28 are journalled in a vertically displaceable bearing block 38. Thus these parts may be displaced upwardly and downwardly conjointly, together with the associated lower roller 22, and may be held fixed in any position. All six hydraulic motors are connected to a common pressure pump installation, indicated schematically in FIG. 2 as including a pump P. Thereby, the peripheral speed of rollers 1 and 2 are so synchronzied with each other that no substantial slip arises between the rollers and the workpiece even when the latter is particularly thick and is bent very strongly.

As compared with bending machines of known construction, a bending machine embodying the invention has not only the advantage of the manifestly substantially smaller space requirement but also, and in addition, still further advantages, For example, relatively small, commercially conventional pressure-fluid operable motors, such as hydraulic motors, may be used, and these, for unit performances, are substantially less expensive than larger specially manufactured motors. The force transmission becomes very favorable since the hydraulic motors may be arranged symmetrically to some extent. Relatively small teeth can be used for the respective spur gears 27 and 28 rotatable with the upper and lower rollers 21 and 22, whereby there is a considerable saving in expense with medium size and larger machines.

The embodiment of the invention shown in FIGS. 2 and 3, and described above, is merely an example of the invention, since many other forms of construction may be adapted. Thus, for example, the number of pinions, each driven by a respective hydraulic motor, can be chosen freely in accordance with the prevailing space requirements, and it is also directly possible to mount drive members at both ends of the bending machine.

While a specific embodiment of the invention has been shown and described in detail to illustrate the application of the principles of the invention, it will be understood that the invention may be embodied otherwise without departing from such principles.

What is claimed is:

1. A four-roller workpiece bending machine comprising, in combination: a frame, a first roller rotatably supported by said frame; a second roller rotatably supported by said frame and disposed below said first roller to cooperate therewith; a gear-wheel provided on said first roller to be rotatable therewith; at least two pinions meshing with said gear wheel; a respective pressure-fluid operable motor for each pinion, having a shaft mounting the associated pinion; and common pump means connected to all said motors to supply pressure-fluid thereto.

2. A machine as defined in claim 1, comprising a gear wheel provided on said second roller to be rotatable therewith; at least one further pinion meshing with said gear-wheel provided on said second roller; and a respective further pressure-fluid operable motor for said further pinion having a shaft mounting said further pinion; each said further motor being connected to said common pump means.

3. A machine as defined in claim 2, comprising four side pinions each in engagement with the first mentioned gear-wheel and two said further pinions each in engagement with said gear-wheel provided on said second roller.

4. A machine as defined in claim 2, including a bearing block mounting the gear-wheel provided on said second roller and each said further pinion; and means operable to vertically displacesaid second roller; said bearing block being movably mounted on said frame to be vertically displaceable with said second roller.

* * * * *